US005681160A

United States Patent [19]

Ellis et al.

[11] Patent Number: 5,681,160

[45] Date of Patent: Oct. 28, 1997

[54] FLARE TIP STRUCTURE AND A METHOD OF DISPOSAL OF GAS ULILIZING SUCH A STRUCTURE

[76] Inventors: John Ellis, 48 Long Park, Chesham Bois, Amersham, Buckinghamshire HP6 5LF, United Kingdom; John C. Boden, 11 Kingsdown Road, Epsom, Surrey, United Kingdom, KT17 3PU; Dennis R. Adcock, 29 Chequers Hill, Amersham, Buckinghamshire, United Kingdom; Steven Warren, Corner Cottage, Upper Church Road, Shedfield, Southampton, United Kingdom, SO3 2JB

[21] Appl. No.: 504,184

[22] Filed: Jul. 19, 1995

[30] Foreign Application Priority Data

Jul. 26, 1994 [GB] United Kingdom ..... 9415412

[51] Int. Cl.[6] ..... F23D 13/20

[52] U.S. Cl. ..... 431/202; 431/4; 431/5; 431/252

[58] Field of Search ..... 431/202, 114, 431/4, 5, 157, 252, 350, 353

[56] References Cited

U.S. PATENT DOCUMENTS

| | | | |
|---|---|---|---|
| 3,730,673 | 5/1973 | Straitz, III | 431/4 X |
| 3,994,671 | 11/1976 | Straitz, III | 431/202 |
| 4,342,550 | 8/1982 | Tuck | 431/4 |
| 4,548,576 | 10/1985 | Chesters | 431/202 |
| 4,652,233 | 3/1987 | Hamazaki et al. | 431/202 |
| 4,669,399 | 6/1987 | Martin et al. | 431/4 X |
| 4,856,985 | 8/1989 | Ochel et al. | 431/202 |

FOREIGN PATENT DOCUMENTS

| | | |
|---|---|---|
| 0 026 067 | 4/1981 | European Pat. Off. . |
| 0 694 736 | 1/1996 | European Pat. Off. . |
| 1471543 | 3/1967 | France . |
| 1064926 | 4/1967 | United Kingdom . |
| 2136577 | 9/1984 | United Kingdom . |

*Primary Examiner*—Larry Jones

*Attorney, Agent, or Firm*—Samuels, Gauthier, Stevens & Reppert

[57] ABSTRACT

A flare tip structure has a tubular component usually mounted at the top of a flare sack which emits waste gas into the atmosphere for disposal by combustion with the aid of one or more pilot burners. Several fluid injectors are mounted inside the component and emit cones of injection fluid, such as natural around the axis of the tubular component. A deflector assists the injectors in creating a cushion of fluid just above the opening of the tubular component to space the combustion flame away from the opening. This allows surrounding air to flow into the gap between the opening and the combustion flame and to mix with waste gas prior to combustion to suppress smoke.

13 Claims, 1 Drawing Sheet

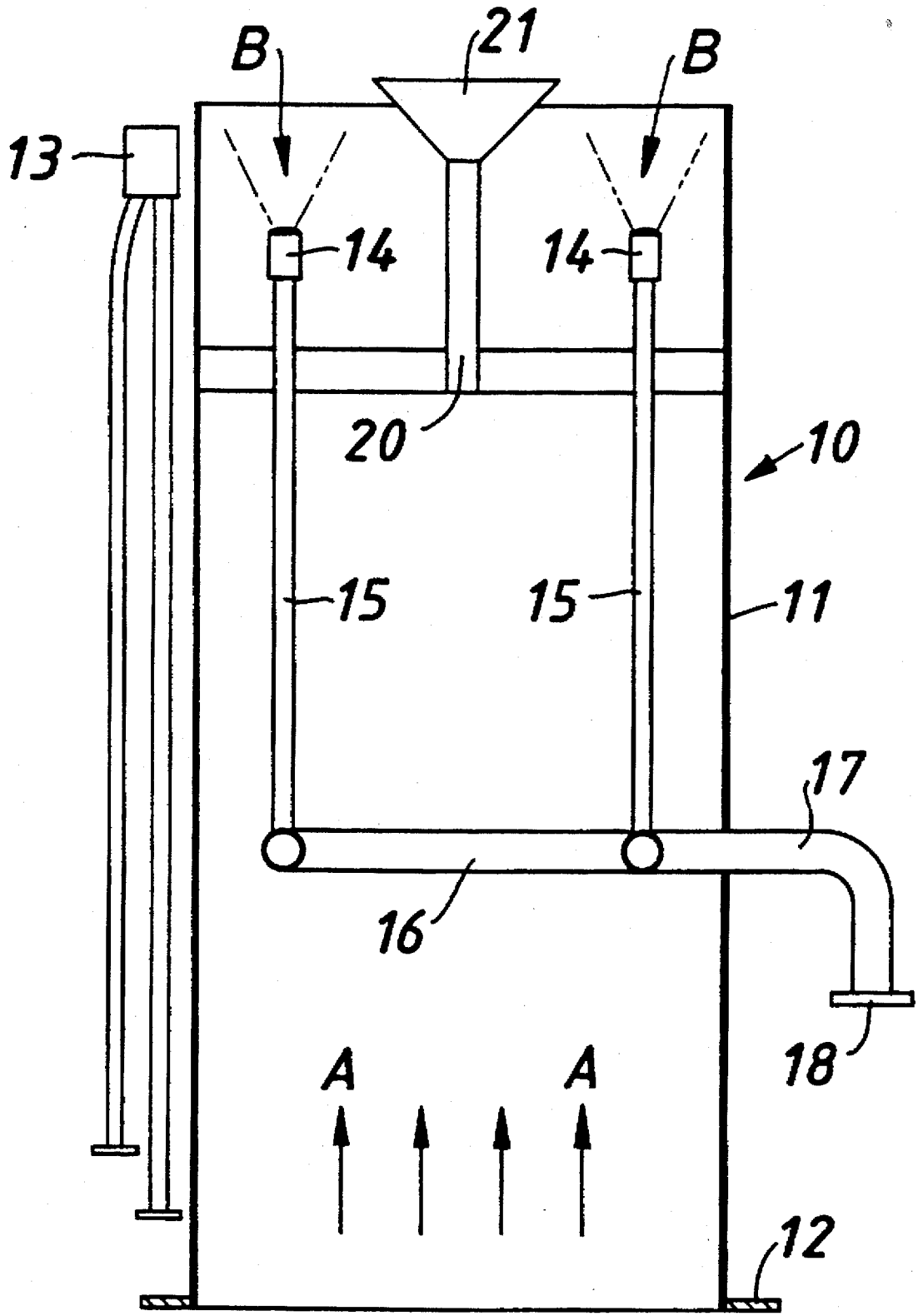
B
21
B
13
14
14
20
10
15
15
11
17
16
18
A
A
12

FLARE TIP STRUCTURE AND A METHOD OF DISPOSAL OF GAS ULILIZING SUCH A STRUCTURE

FIELD OF THE INVENTION

The present invention relates in general to flares and to a method of disposal of waste gas by combustion.

BACKGROUND OF THE INVENTION

Normally waste gas is burnt off at the top of an elevated flare stack tip. When burning heavy hydrocarbons flowing at low velocities smoke is created which is injurious to the environment. In modern refineries and chemical plants fluids such as steam, air or suitable gas is injected into the waste gas to suppress smoke but this can become rather costly.

BRIEF SUMMARY OF THE INVENTION

According to one aspect of the invention there is provided a method of disposing of waste gas by combustion comprising causing the waste gas to flow from a discharge opening into a combustion zone open to the atmosphere and emitting fluid into the waste gas to cause the combustion flame front to be lifted above the discharge opening.

Conveniently, the discharge opening is formed by a tubular component of an elevated flare tip structure and the fluid is emitted from the interior of the component towards the opening. Thus, according to the present invention fluid is injected into the waste gas but in a manner to lift the combustion flame front above the discharge opening of the flare tip structure. This spacing of the flame permits air to flow into and mix with the unburned waste gas prior to combustion and this has been found particularly effective in suppressing smoke and in maintaining stability. The fluid can be emitted as discrete jets which tend to increase the velocity of the waste gas discharging through the opening.

In a preferred embodiment the fluid is emitted by a number of injectors in the form of nozzles disposed in the tubular component with the discharge opening and positioned inwardly from the opening. Any wind tends to assist the quantity of air drawn into the rising gas column prior to combustion. The injectors may be multi-holed nozzles designed to emit cones of fluid at a predetermined spray angle to minimise noise. The jets of fluid may be such as to just reach the opening and to merge to create a cushion beneath the combustion flame.

In accordance with another preferred feature of the invention a diverter, which may be of frusto-conical shape, is disposed partly in the opening to stabilise the flame and prevent the occurrence of blow out. No additional flame retention devices are needed.

The invention may be understood more readily and various other aspects and features of the invention may become apparent from consideration of the following description.

BRIEF DESCRIPTION OF THE DRAWINGS

An embodiment of the invention will now be described, by way of example only, with reference to the accompanying drawing which is a schematic side elevation of a flare tip structure constructed in accordance with the invention.

DESCRIPTION OF PREFERRED EMBODIMENT

As shown in the drawing a flare tip structure 10 is composed of a tubular component 11 usually mounted in an elevated position on another tubular component with which it is inter-connected with the aid of a flange 12 at the lower end. The component 11 is open at the upper end to emit waste gas for disposal by combustion. A pilot burner 13 is mounted on the exterior of the component 11 to ignite the waste gas, although a number of pilot burners 13 can be employed.

In accordance with the invention, a number of fluid injectors 14 are mounted within the component 11 upstream of the open end. The injectors 14 are conveniently mounted on feed pipes 15 leading to a tubular manifold 16. The manifold 16 leads through an elbow 17 passing through the wall of the component 11 and the elbow 17 has an end flange 18 for connection to a pipe leading to a source of injection fluid. The injectors 14 are disposed about the longitudinal axis of the component 11. A frusto-conical deflector 21 is mounted at the centre of the open-end of the component 11 and is supported by support means 20 which also supports the pipes 15.

During use, waste gas passes up through the component 11 as indicated by arrows A and the injectors 14 emit cones of fluid as indicated by reference B.

The presence of the fluid cones B creates a cushion of fluid above at the opening of the component 11 to cause the combustion flame front created by the burning waste gas to be spaced above the opening of the component 11. This cushion of fluid allows surrounding air to flow into the waste gas and to mix with the waste gas prior to combustion. This has been found to suppress smoke.

In one construction the tubular component had a diameter of about 60 cms and the injection fluid was natural gas at a pressure of 310264 $N/m^2$ (45 psi).

Tests have shown the amount of injection fluid consumed in suppressing smoke by lifting the combustion flame as described is lower than with conventional methods and the noise is less.

We claim:

1. A flare tip structure for mounting in an elevated position to dispose of waste gas by combustion in the atmosphere; said structure comprising a tubular component with first and second ends and means defining an interior space establishing a path for the waste gas to flow from the first end to the second end, the second end of the tubular component being open to the atmosphere to discharge all the waste gas for mixing with combustion air from the atmosphere by natural induction wholly outside the tubular component; and a plurality of fluid injectors disposed in the interior space of the tubular component adjacent the second end thereof, said fluid injectors being arranged to emit jets of fluid in a direction towards the second end of the tubular component to cause a combustion flame resulting from combustion of the air and waste gas outside he tubular component to be spaced from the second end of the tubular component.

2. A flare tip structure according to claim 1, wherein the interior space has a longitudinal central axis extending from the first to the second end of the tubular component and the structure further comprises a frusto-conical deflector mounted at the second end of the tubular member in a position aligned with the longitudinal central axis to deflect the waste gas flowing out from the second end into the atmosphere and to stabilize the combustion flame.

3. A flare tip structure for mounting an elevated position to dispose of waste gas by combustion in the atmosphere; said structure comprising a tubular component with first and second ends and means defining an interior space establishing a uniform flow path for the waste gas to flow from the first end to the second end, the second end of the tubular component being open to the atmosphere to discharge all the waste gas into the atmosphere from the second end for combustion in the atmosphere; and a plurality of fluid injectors disposed in the interior space of the tubular component which serve to emit jets of fluid which mix directly with the waste gas flowing through the interior space and for discharge along with the waste gas into the atmosphere, the jets of fluid serving to create a combustion flame from combustion of the waste gas and air induced from the atmosphere said flame being spaced beyond the second end relative to the interior space.

4. A flare tip structure according to claim 3, wherein the interior space has a longitudinal central axis extending from the first to the second end of the tubular component and the structure further comprises a frusto-conical deflector mounted at the second end of the tubular member in a position aligned with the longitudinal central axis to deflect the waste gas flowing out from the second end into the atmosphere and to stabilize the combustion flame.

5. A flare tip structure according to claim 3, wherein the fluid injectors are adjacent the second end of the tubular component and spaced inwardly from the second end.

6. A method of disposing of waste gas by combustion in the atmosphere, said method comprising causing all the waste gas to flow along a path for discharge from an opening into the atmosphere for mixing with air induced naturally from the atmosphere to support combustion in a zone open to the atmosphere and emitting fluid into the waste gas prior to its discharge from the opening to cause a resultant-combustion flame front to be spaced beyond the opening relative to the combustion zone.

7. A method of disposing of waste gas according to claim 6 wherein said fluid is emitted as conical jets from a plurality of injectors.

8. A method of disposing of waste gas according to claim 7 wherein said conical jets merge with one another in the vicinity of the opening.

9. A method of disposing of waste gas according to claim 6 wherein the fluid is natural gas.

10. A method of disposing of waste gas comprising causing all the waste gas to pass through a tubular component and to discharge through an opening thereof for combustion and emitting fluid from the interior of the tubular component and towards the opening along with the waste gas to cause the combustion flame front to be spaced from the opening and to promote air to flow and mix with the waste gas naturally and only after discharge from the opening and prior to combustion.

11. A method of disposing of waste gas according to claim 10 wherein said fluid is emitted as conical jets from a plurality of injectors.

12. A method of disposing of waste gas according to claim 11 wherein said conical jets merge with one another in the vicinity of the opening.

13. A method of disposing of waste gas according to claim 10 wherein the fluid is a natural gas.

* * * * *

UNITED STATES PATENT AND TRADEMARK OFFICE

CERTIFICATE OF CORRECTION

PATENT NO. : 5,681,160

DATED : October 28, 1997

INVENTOR(S) : Ellis et al.

It is certified that error appears in the above-indentified patent and that said Letters Patent is hereby corrected as shown below:

On the title page, item [54]: after "GAS" delete -- ULILIZING -- and add "UTILIZING".

item [76] Inventors: Line 8, delete -- Steven Warren -- and add "Stephen Warren".

Column 1, Line 2, after "GAS" delete -- ULILIZING -- and add "UTILIZING".

Signed and Sealed this

Thirty-first Day of March, 1998

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,681,160

DATED : October 28, 1997

INVENTOR(S) : John Ellis et al.

It is certified that error appears in the above-indentified patent and that said Letters Patent is hereby corrected as shown below:

On the title page: item [73] Assignee: Hamworthy Combustion Engineering Limited, United Kingdom Signed and Sealed this Twentieth Day of June, 2000

*Attest:*

Q. TODD DICKINSON

*Attesting Officer*

*Director of Patents and Trademarks*